US007780575B1

(12) United States Patent
Goodwin, III et al.

(10) Patent No.: US 7,780,575 B1
(45) Date of Patent: Aug. 24, 2010

(54) METHOD AND APPARATUS FOR PARALLETT AND BALLET BAR FIXTURE

(76) Inventors: William H. Goodwin, III, 8 Roslyn St., Salem, MA (US) 01970; Jody R. Goodwin, 8 Roslyn St., Salem, MA (US) 01970

( * ) Notice: Subject to any disclaimer, the term of this patent is extended or adjusted under 35 U.S.C. 154(b) by 655 days.

(21) Appl. No.: 11/010,881

(22) Filed: Dec. 13, 2004

Related U.S. Application Data

(60) Provisional application No. 60/529,674, filed on Dec. 15, 2003.

(51) Int. Cl.
*A63B 4/00* (2006.01)
*A63B 1/00* (2006.01)

(52) U.S. Cl. ..... 482/34; 482/40

(58) Field of Classification Search ..... 482/38–41, 482/23–25, 31–34; 5/636
See application file for complete search history.

(56) References Cited

U.S. PATENT DOCUMENTS 3,083,964 A * 4/1963 Wentzel ..... 482/34
3,258,790 A * 7/1966 Maru ..... 5/636
4,406,450 A * 9/1983 Regan ..... 482/41
4,854,573 A * 8/1989 Johannson et al. ..... 482/141
5,180,349 A * 1/1993 Marcus ..... 482/34
5,466,206 A * 11/1995 Fleming ..... 482/141
5,467,490 A * 11/1995 Rice ..... 5/636

* cited by examiner

*Primary Examiner*—Fenn C Mathew
(74) *Attorney, Agent, or Firm*—Stan Jones, Patents

(57) ABSTRACT

Triangular shaped smooth outside and cavities inside with a PVC parallett/ballet bar supported by blind holes at the top of a pair of triangular end caps. End cap bar opening has a ridged inside dimension that is tapered slightly from the inside to the outside surface areas. Tapering by ridged ramps located inside that bar opening, allows the end caps and bar to forcibly seize unto each other with a firm bond requiring no further fastening agent. Bar may include a filler pole for rigidity especially in longer length devices. End caps likewise seize and hold both a PVC bar and/or the PVC/filler insert combination.

13 Claims, 3 Drawing Sheets

METHOD AND APPARATUS FOR PARALLETT AND BALLET BAR FIXTURE

PREVIOUS FILING INFORMATION

On Dec. 15, 2003 the United States Patent Office received a copy of—and assigned Ser. No. 60/529,674 to—a Provisional Patent Application (PPA) filed by the same inventors hereof. That PPA is incorporated herein by this reference as though set out here in full. Additionally, the PPA is being supplemented by this Regular Patent Application (RPA). Applicant expressly reserves all rights and privileges flowing from the PPA and its earlier official filing date and contents thereof. This RPA follows, and it is supported by the PPA.

BACKGROUND OF THE INVENTION

Field of the Invention

This invention relates to gymnastics, dance and general exercise methods and apparatus. More specifically, the field of this invention relates to novel end caps for receiving a bar in the form of a pipe or PVC section suitable for use in doing handstands, pirouette, ballet and similar type exercise activities. Additionally the field of this invention relates to a non-gymnasium or at home setting for gymnastic type exercises.

Our invention involves a pair of smooth surface triangular-shaped end caps having aligned blind openings for receiving a bar that allows a user to do handstands and other gymnastic movements. A novel exercise system results from a simple, easy to use apparatus that may easily be moved from place to place as necessary for competition in a sport that is increasingly becoming highly mobile.

EXPLANATION OF TERMS

Set out below are brief descriptions of certain relevant terms which further the understanding of the invention. These terms provide a basis for a detailed teaching of the improvements of this invention in the relevant arts. Such terms are not intended to replace the claims but rather serve as helpful guides in understanding our novel improvements in these arts.

End Caps.

Matching end caps are formed from extruded or molded plastic material. A pair of such end caps and a short section of pipe such as PVC schedule 40 or schedule 80 can be used to form a handstand parallett for use on the floor. Or such end caps may slide into an attachment fixture which allows mounting same on a wall as a ballet, dance or chin-up exercise bar.

Each end cap is triangular shaped with five sides and a smooth continuous outside surface area having on the inner surface thereof supporting ribs and a single blind opening located at the top, which opening is sized to receive an inch and one-half diameter PVC pipe of a given length. The end caps may be formed by extruding or by a hot injection molding technique. A pair of such end caps is required in order to hold a 1½ inch pipe (bar) section between the cap pair. One pair with the pipe section fit in place is needed for both the right and the left hand side of a gymnast doing certain training exercises such as handstands, leg lifts, push-ups and the like.

Tapers for the Bar Openings

Each end cap bar-receiving opening has a tapered fit to the outside circumference of the cross bar. In one embodiment the tapers take the form of raised ramp ridges running from the opening to the blind base of the bar-receiving openings.

The highest end of the ridge ramp is at the opening while the shallowest ramp end is at the blind end of the opening. When the end caps are struck a blow and are driven home to the cross bar, these tapers seize the entire parallett together.

Wall Mounted Parallett.

The base of each end cap is grooved on opposed sides of its length with longitudinal slots. These slotted grooves mate with and slidably fit into a matching attachment fixture having an open end, a closed end and an inwardly directed rib pair. The attachment fixture includes—on the inner surface thereof—countersunk holes for receiving screws that allow the attachment piece to be screwed to vertical surfaces. The longitudinal grooves of an end cap slide into mating slots defined by such inwardly directed ribs of the attachment fixture. A pair of such end caps, one cap each slid into position into these wall attachment fixtures serve to hold a parallel bar at a given height above the floor that is suitable for ballet training, chin-up exercises or the like.

Reinforced Parallett Rail.

Some give and resilience in response to moves being practiced by a user are desirable. Such characteristics are simulated to by the PVC and PVC/filler feature of my invention. The hollow PVC bar-when filled by a more rigid pole insert—supplies a different feel to the parallett. We have noted that a wooden rod—similar to the wooden poles used in closets—is an advantageous accessory to our new parallett invention.

Since a 1 and ½ inch PVC pipe readily receives most standard closet-type poles, a wooden filler pole will slide directly in the PVC section that has been selected by length for the parallett being used.

DESCRIPTION OF PRIOR ART

Paralletts are known. They are used for exercise and by gymnasts for training. Generally speaking such devices have round hand grips which are constructed from hardwood. Handstands, leg lifts and pushups, along with other similar exercises may easily be accomplished when such paralletts are placed on the floor.

The prior art devices are characterized by glued together pieces of hardwood having a short pole or dowel section connected between some upright brace-type end pieces. Such devices are bulky, heavy and are subject to breakage and splintering.

What has not yet been provided, in order to fill a long sought for need, is a lightweight but sturdy, smooth gymnastic training item as taught by this invention.

SUMMARY OF THE INVENTION

In the invention, each five sided triangular shaped end cap has a flat base surface that is intended to sit flush against a flat surface. Blind cavities are formed in each end cap. Such cavities define a surrounding peripheral wall which includes a grooved base and a pair of vertical mounting support ribs which support a single top blind opening for each end cap. The outer surface area of each end cap is continuous, smooth and essentially flat and is chosen with a thickness sufficient to safely support the highly skilled gymnast—and novices as well—regardless of size, weight or vigorous bar activities. A chosen radius of curvature for the wall thickness and exposed inner peripheral wall supplies rigidity, strength and user safety for a PVC system of this parallett invention.

At the top of each triangular end cap, the outer peripheral wall joins with a circular surrounding wall forming a closed or blind hole about 1 and 9/10 inches in diameter. The one only blind hole has a PVC lock for the bar. That lock, in a preferred embodiment, takes the form of a quadrant of raised tapered ridges. These locking ridges run from the end cap inner surface to the back of the smooth outer wall. Although only slightly tapered, these ridges come into play when the parallett is assembled the first time. With the bar partially inserted and allowing some play in the pieces, the end caps are placed flat on the floor. Then a rubber mallet is employed to drive the end caps home on the bar in a self aligning feature for the parallett. The taper ridges are deformed within and thus lock the parallett pieces together for a safe and sound exercise system.

A pair of end caps lockably supports a selected length of PVC pipe (bar) with an outside dimension which fits snugly in the longitudinally aligned blind holes of a pair of end caps. Such pipe sections may be of various materials or of varying selected lengths. Typical lengths, in inches, are 12, 24, 54, 57, and 60. Longer pipe lengths, if hollow, will be too flexible. Accordingly they advantageously may be filled with a rigid pole such as, for example, a wooden pole section that is sized to slide into and fit within the inner diameter of the bar.

Competitive or professional gymnastic equipment provides a familiar feel of some give and resilience in response to moves being practiced by the user. Such characteristics are accurately simulated by the PVC sections of my invention. The length and strength of a selected Schedule PVC pipe controls the amount of give and resilience. Additionally, the stiffness of the inner filler pole section may, if desired, also be varied to custom control the give and resilience for a particular user.

Along the base of each end cap is a grooved slot that matches ribs of a slotted wall bracket assembly piece. Inwardly directed ribs on the bracket piece match and mate with the grooved slot provided above the base surface of the end caps. By using a pair of spaced apart wall bracket pieces which have been mounted by screws to a wall, the user is afforded a vertical surface attachment for the end caps. Bar exercises—such as ballet and dance, for example—may then be performed on a lower bar, while chin-ups and arm curls may be performed by use of a higher wall mounted bar connected for example, across a door opening.

The novel features of the disclosed invention provide many novel benefits. These benefits are set forth in our web site under www.stan-ray products.com. The contents of the web site are hereby incorporated herein as though set forth in full at this point.

Achieved by this invention are some of the following features and benefits:

- Lightweight and readily transportable.
- Readily available for home, office and non-gymnasium use.
- Easy to set up and/or takedown.
- Packs conveniently for shipment.
- Provides a wide variety of exercise, dance and gymnastic uses in a simple affordable apparatus.
- Self locking end caps to bars of selected lengths.
- Inside blind cavities and smooth outside end caps surface for safety and improved appearance.
- Nylon PVC of ABS or HIPS types.
- Schedule 40 or Schedule 80 PVC parallett pole between a pair of end caps.
- End caps grooved to mate with vertical attachment piece for horizontal of vertical operation.

DRAWINGS

DETAILED DESCRIPTION OF THE PREFERRED EMBODIMENT

Figure 1:
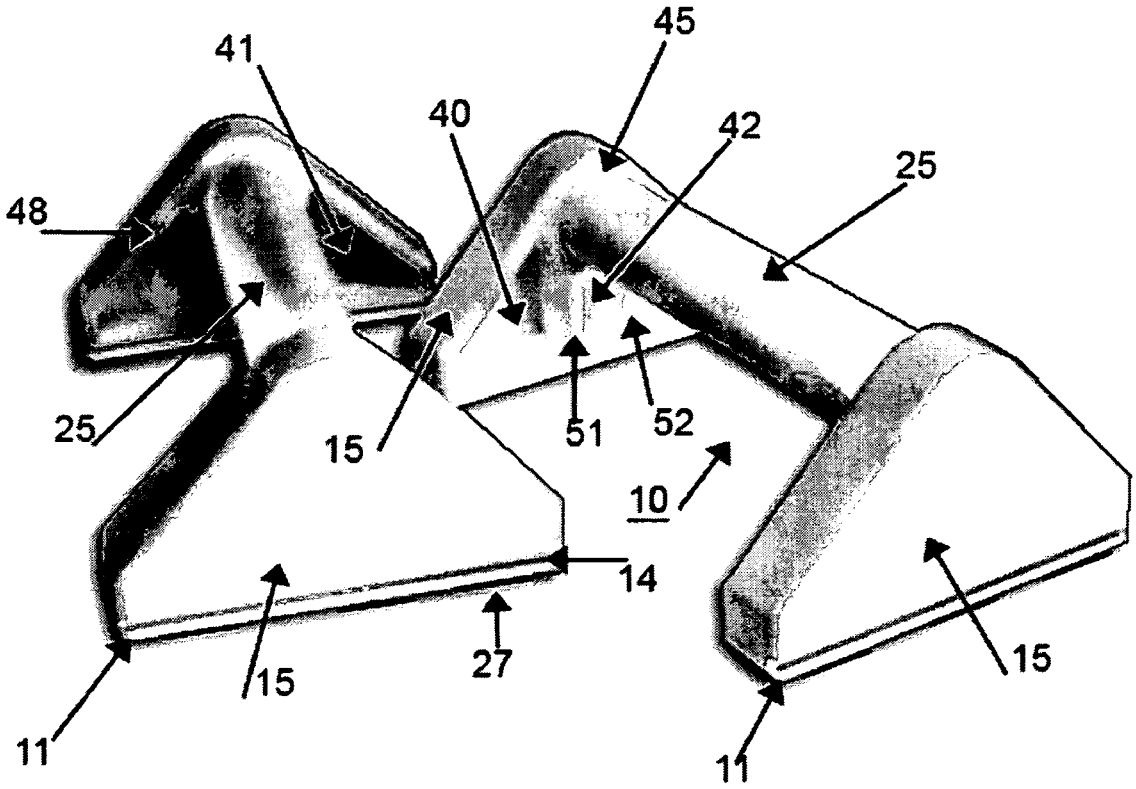
FIG. 1 is a top perspective view of a pair of paralletts in accordance with the invention.

FIG. 1 depicts a pair of paralletts in accordance with the principle of this invention. Each parallett 10 comprises a pair of opposing end support caps 15 having bridged there across a single bar 25. For floor based exercises such paralletts rest upon the floor. Right and left handholds are provided by the pair of bars 25 which are held horizontal to the floor and spaced a few inches away from the surface of the floor.

End support caps 10 each have a flat base surface 11 that is intended to sit flush against the floor and hold a pressure sensitive non-skid bottom strip 27. These end support caps are smooth on the outside triangular surface, while the inside surfaces have formed therein a series of cavities 40, 41, 42 and 45. These cavities are best shown in the background view of the inside surface of the end caps 15 of FIG. 1. Such cavities are defined by wall and rib sections that terminate around a circular blind opening 45 located at the top of each triangular end cap 15 as shown enlarged for clarity in FIG. 3.

A peripheral wall 48 having a thickness which is selected to supply rigidity and strength to the end cap surrounds the cavities and defines the outer dimension of each end support cap 15. At the top of each triangular end cap 15, the outer peripheral wall 48 joins with a circular surrounding wall forming a closed or blind bar-receiving opening 45. (Enlarged in FIG. 3.) Additionally included, is a pair of spaced apart ribs 51, 52 which run vertically from the base upward to a lower circular arc portion of the blind hole 45. Such ribs 51, 52 provide additional strength and rigidity.

Along the base of each end cap is a grooved slot 14. That slot 14 matches a mating groove 45 in our wall bracket assembly piece 40, shown in FIG. 2.

Figure 2:
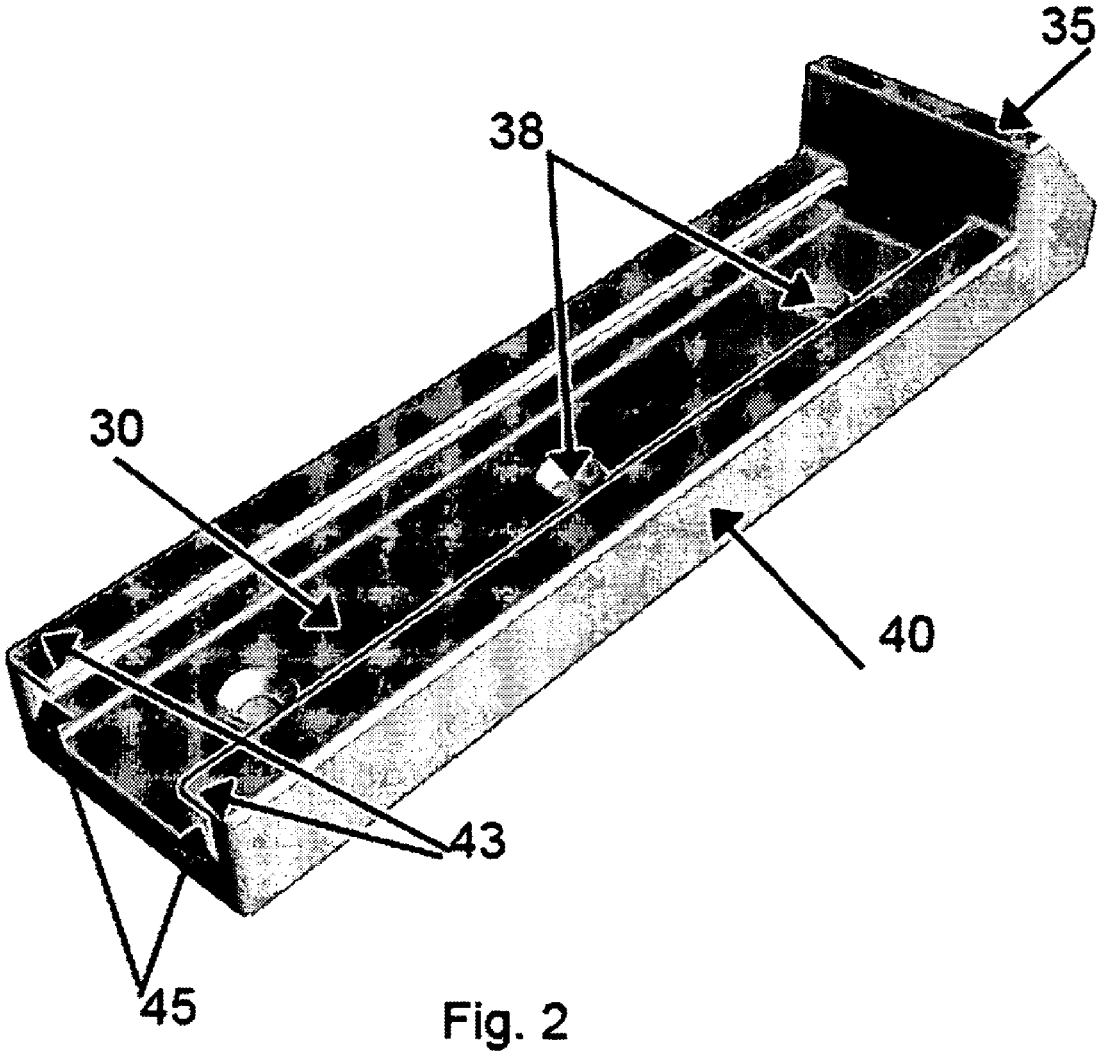
FIG. 2 shows an end view of one end cap support of FIGS. 1.

Wall bracket assembly piece 40 of FIG. 2 includes an open end 30 and a closed end 35. A groove 45 on each bracket piece 40 includes inwardly directed tongues 43 that match and mate with the grooved slot 14 provided along the base surface of each end cap 15, FIG. 1. The two pieces, end caps 15 and bracket pieces 40 fit together hand in glove with some slight play for ease of assembly.

By using a pair of spaced apart wall bracket pieces 40—which have been mounted by screws to a wall through recessed screw openings 38, the user is afforded a vertical surface attachment for our parallett/ballet bar invention. Bar exercises—such as ballet and dance, for example—may then be performed on a lower bar, while chin-ups and arm curls may be performed by use of a wall mounted higher bar connected across a door opening. Our web site shows and describes some typical use for the vertically mounted features of our invention.

Figure 3:
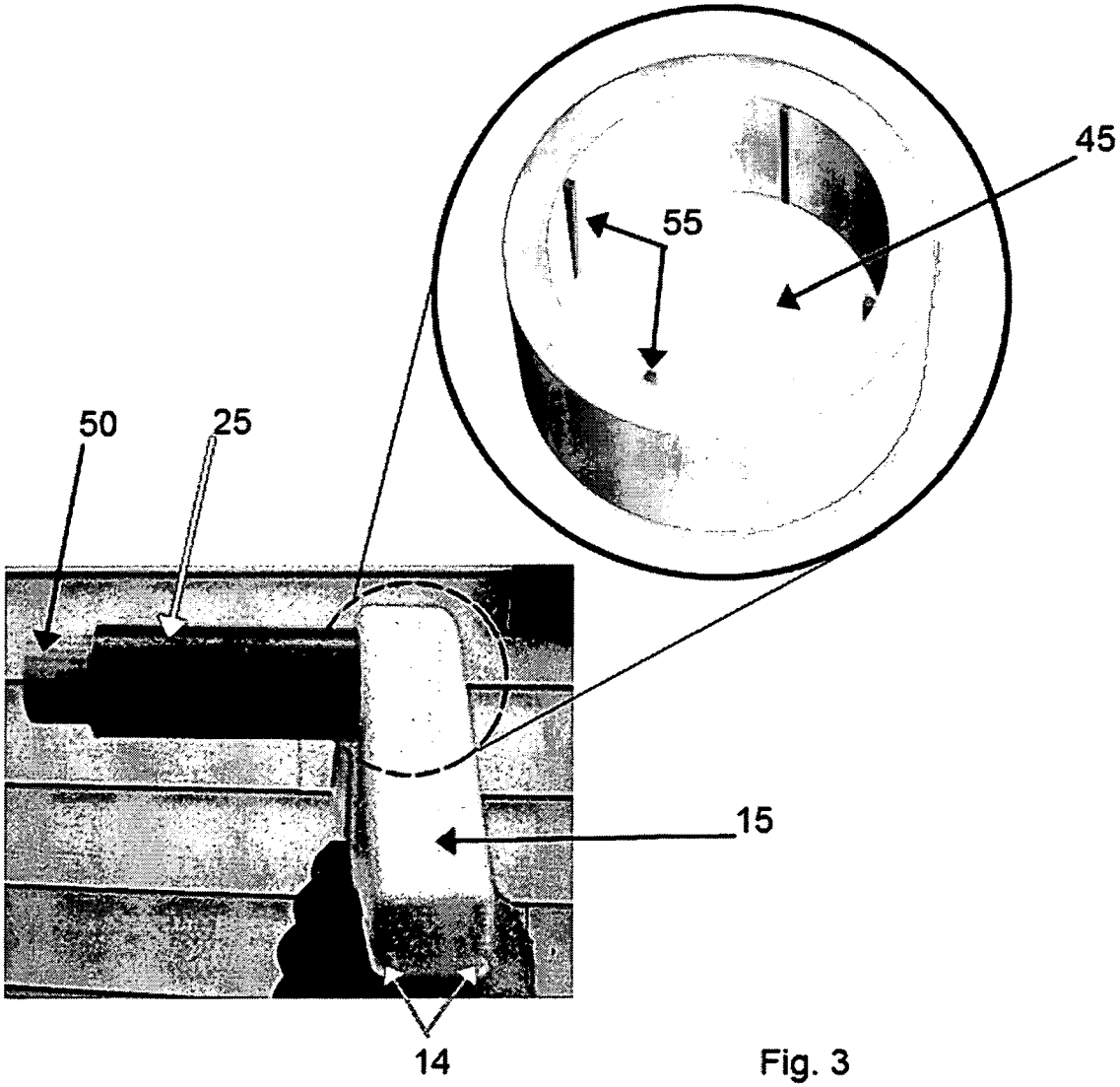
FIG. 3 depicts a partial perspective view of an inner rod filling the hollow pipe of FIG. 1.

FIG. 3 depicts an enlargement of the bar-receiving opening 45. Inside the opening 45 are four taper ridges 55. As shown, the higher taper end is located at the inside surface of end cap 15. The particular number of taper ridges is not to be taken as limiting but we have found success with four ridges 55 located at the quadrants of opening 45.

Also depicted in FIG. 3 is a Schedule 80, or dark bar 25. At the left end of bar 25 the wooden insert or pole 50 is depicted. Please note the ends of grooves 14 which are shown at the base of the end cap 15. When used in the vertical position, these grooves receive the inwardly directed lips 43 of the wall attachment piece 40.

While my invention has been described with reference to particular examples of some preferred embodiments, it is my intention to cover all modifications and equivalents within the scope of the following claims. It is therefore requested that the following claims, which define my invention, be given a liberal interpretation commensurate with my contribution to the relevant technology.

What is claimed is:

1. A parallett/ballet bar apparatus having a single horizontal cross bar affixed between a pair of five sided triangular-shaped end caps with each cap of the pair having an inner surface face, a solid outer surface face and adapted to rest on a base in either a horizontal or held, once so placed, in a vertical position by said adaptation free of manual support, and the parallett/ballet bar apparatus comprising:

a pair of end caps being formed from PVC with a continuous smooth outside surface face that is completely solid thereby preventing a plurality of cavities formed on the inside surface face thereof from extending all the way through the end caps;

said cavities comprising one only blind bar-receiving opening positioned and formed at the top of each one of said pair of five sided triangular end caps but having a depth that does not extend through to the solid outer surface thereof and said end caps each being fitted with an attachment means at the base;

each end cap bar opening having a tapered inside dimension with the taper running slightly higher on the end caps inside surface to a lower dimension located at the blind closed end formed inside the solid outside surface area;

a single PVC cross bar inserted into said one only bar opening in said pair of end caps;

said tapered inside for the bar openings causing the end caps and the cross bar to seize unto each other with a firm bond requiring no further fastening agent; and said attachment means separated in two pieces with one piece being a wall bracket assembly and the other piece being a selectively joinable mating groove on the base of said apparatus allowing interchangeable use of said apparatus mounted on either a vertical wall surface or placed on a horizontal surface.

2. The apparatus in accordance with claim 1 wherein said bar is a hollow selected length of PVC pipe, and said apparatus further comprising:

a rigid filler pole inserted within the hollow PVC pipe length.

3. The apparatus in accordance with claim 2 and further comprising:

said taper inside includes raised ramp ridges inside said bar receiving openings.

4. The apparatus of claim 3 wherein the tapers of each bar-receiving opening of said end caps further comprises:

raised ramp ridges running from the bar-receiving opening to the blind closed end base at the rear of said bar-receiving opening.

5. The apparatus of claim 4 wherein the raised ramp ridges of each bar-receiving opening of said end caps further comprises:

a highest end of the ridge ramp at the opening of the end cap on the inside face surface while the shallowest ramp end is toward the blind closed end of said bar-receiving opening.

6. The apparatus of claim 1 wherein said inside face surface comprises several cavities, with said cavities further comprising:

circular wall and rib sections that terminate around said circular blind bar-receiving opening with an upper arc portion of the circular wall peripherally surrounding said bar-receiving opening and defining a smooth rounded edge located at the top of said triangular-shaped end cap;

said peripheral surrounding wall having a thickness which is selected to supply rigidity and strength to the end cap, with said peripheral wall surrounding and forming the outer edge dimension of each end support cap; and a pair of spaced apart vertical ribs running from the base to a bottom circular arc surrounding said bar opening and joining with the upper arc portion in order to provide additional support and rigidity of said apparatus.

7. A parallett/ballet bar apparatus having a single horizontal cross bar affixed between a pair of triangular-shaped end caps with each cap of the pair having an inner surface face, a solid outer surface face and adapted to rest on a base in either a horizontal or be fixably mounted by a wall bracket fixture in a vertical position, and the parallett/ballet bar apparatus comprising;

a pair of end caps being formed from PVC with a continuous smooth solid outside surface face and a plurality of cavities formed on the inside surface face thereof;

said cavities comprising one only blind bar-receiving opening positioned and formed at the top of each one of said pair of said triangular end caps with an attachment means at the base;

each end cap bar opening having a tapered inside dimension with the taper running slightly higher on the end caps inside surface to a lower dimension at the smooth end cap outside surface area;

a single PVC cross bar inserted into said one only bar opening in said pair of end caps;

said tapered inside for the bar openings causing the end caps and the cross bar to seize unto each other with a firm bond requiring no further fastening agent; and said attachment means on the base of said apparatus mating with the fixably mounted wall bracket in order to allow interchangeable use of said apparatus on either a vertical or a horizontal surface and further wherein each base of said triangular-shaped end caps forms part of said attachment means, and said wall bracket attachment includes a separate mating vertical mounting fixture, with said attachment means further comprising:

a pair of opposed longitudinal grooves formed along the length of said base in each end cap of a given end cap pair;

said separate vertical attachment fixture having dimensions slightly larger than the end cap base and wherein, said attachment fixture has an open end, a closed end and an inwardly directed pair of ribs defining a pair of opposed longitudinal slots; and the longitudinal grooves of each end cap of a given pair slide into and mate with the slots defined by the inwardly directed ribs of the wall bracket attachment fixture allowing said apparatus to be connected to a vertical surface.

8. The apparatus of claim 7 wherein said attachment fixture further comprises:

wall bracket mounting means allowing for said attachment fixture to be securely affixed to a vertical surface; and said end caps each connected to said attachment fixture by said mating grooves and fixture slots to hold a parallel bar at a given height above the floor that is suitable for ballet training, and/or chin-up exercises.

9. The apparatus in accordance with claim 7 wherein said attachment fixture further comprises:

holes on the inner surface thereof located between said slots for receiving screws that allow the attachment piece to be permanently affixed to a vertical surface.

10. A PVC ballet bar/parallett apparatus having a single PVC horizontal cross bar affixed between a pair of end caps, and the apparatus comprising a pair of PVC end caps, each end cap having smooth continuous solid outside surface faces free of any discontinuities or openings;

a blind bar-receiving opening on the inside face surface of the end caps but not extending through to the exterior smooth solid outside surface face of said end cap;

each of said blind bar-receiving openings having a tapered inside dimension;

a single PVC bar affixed between the bar-receiving openings of a pair of end caps; and attachment-receiving means on the base of said PVC parallett allowing the user to interchangeably rest said parallett on a horizontal surface or mount same free of manual support as a ballet bar or chin-up exercise device secured to a vertical surface.

11. The apparatus of claim 10 further comprising:

a pair of opposed longitudinal grooves formed along both sides of the length of each end cap base;

an attachment fixture suitable for being fixably mounted on a vertical surface having an open end, a closed end and an inwardly directed pair of ribs defining a pair of opposed longitudinal slots; and the longitudinal grooves of an end cap slide into and mate with the ribs of the mountable attachment fixture.

12. A method of assembling the parallett/ballet bar apparatus of claim 10 comprising the steps of:

inserting the bar loosely into the tapered openings;

allowing the loosely assembled apparatus to self align while on a horizontal surface;

driving the cross bar home into the tapered openings of a pair of end caps by striking the end caps with a rubber mallet.

13. A method of assembling the apparatus of claim 12 comprising the additional steps of:

affixing and mounting a pair of spaced attachment fixtures on a vertical surface with the bar-receiving openings aligned with each other; and sliding the longitudinal grooves of each end caps from the open end to the closed end of the attachment fixtures in order to fixably attach same to the vertical surface when so joined together.

* * * * *